US006494736B2

(12) United States Patent
Mito

(10) Patent No.: US 6,494,736 B2
(45) Date of Patent: Dec. 17, 2002

(54) CONNECTOR FOR A BATTERY CHARGER

(75) Inventor: Toshitsugu Mito, Atsugi (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/804,338

(22) Filed: Mar. 12, 2001

(65) Prior Publication Data

US 2001/0023145 A1 Sep. 20, 2001

(30) Foreign Application Priority Data

Mar. 14, 2000 (JP) ..... 2000-071115

(51) Int. Cl.[7] ..... H01R 4/38
(52) U.S. Cl. ..... 439/385; 439/357
(58) Field of Search ..... 439/357, 350, 439/382, 384, 385, 358; 320/132

(56) References Cited

U.S. PATENT DOCUMENTS 4,299,433 A * 11/1981 Jayne ..... 439/329
5,393,235 A * 2/1995 Ingalsbe ..... 439/76
5,513,999 A * 5/1996 Fry et al. ..... 200/51.09
5,634,817 A * 6/1997 Siemon et al. ..... 439/608
6,071,141 A * 6/2000 Semmeling et al. ..... 439/353
6,146,180 A * 11/2000 Betker et al. ..... 439/352
6,191,552 B1 * 2/2001 Kate et al. ..... 307/155
6,254,417 B1 * 7/2001 Pan ..... 439/350

OTHER PUBLICATIONS

Merriam Webster's Collegiate Dictionary, 10th ed. 1999.*

* cited by examiner

*Primary Examiner*—Gary Paumen
*Assistant Examiner*—James R. Harvey
(74) *Attorney, Agent, or Firm*—J. Bruce Schelkopf

(57) ABSTRACT

A connector for a battery charger is configured so that a latching member protrude from a connector body, a connector portion is disposed in the lower portion of a latching member, and a keep plate is fixed at the bottom face 12A. When the connector portion is connected to a battery connector located in a recess of a battery pack, hooks of the latching member fit in grooves of the recess, thereby the keep plate 14 comes in contact with a bottom face of the battery pack and the battery connector is pinched between the keep plate and the latching member. The connector is thus locked in the connection state.

5 Claims, 13 Drawing Sheets

[Figure 1]
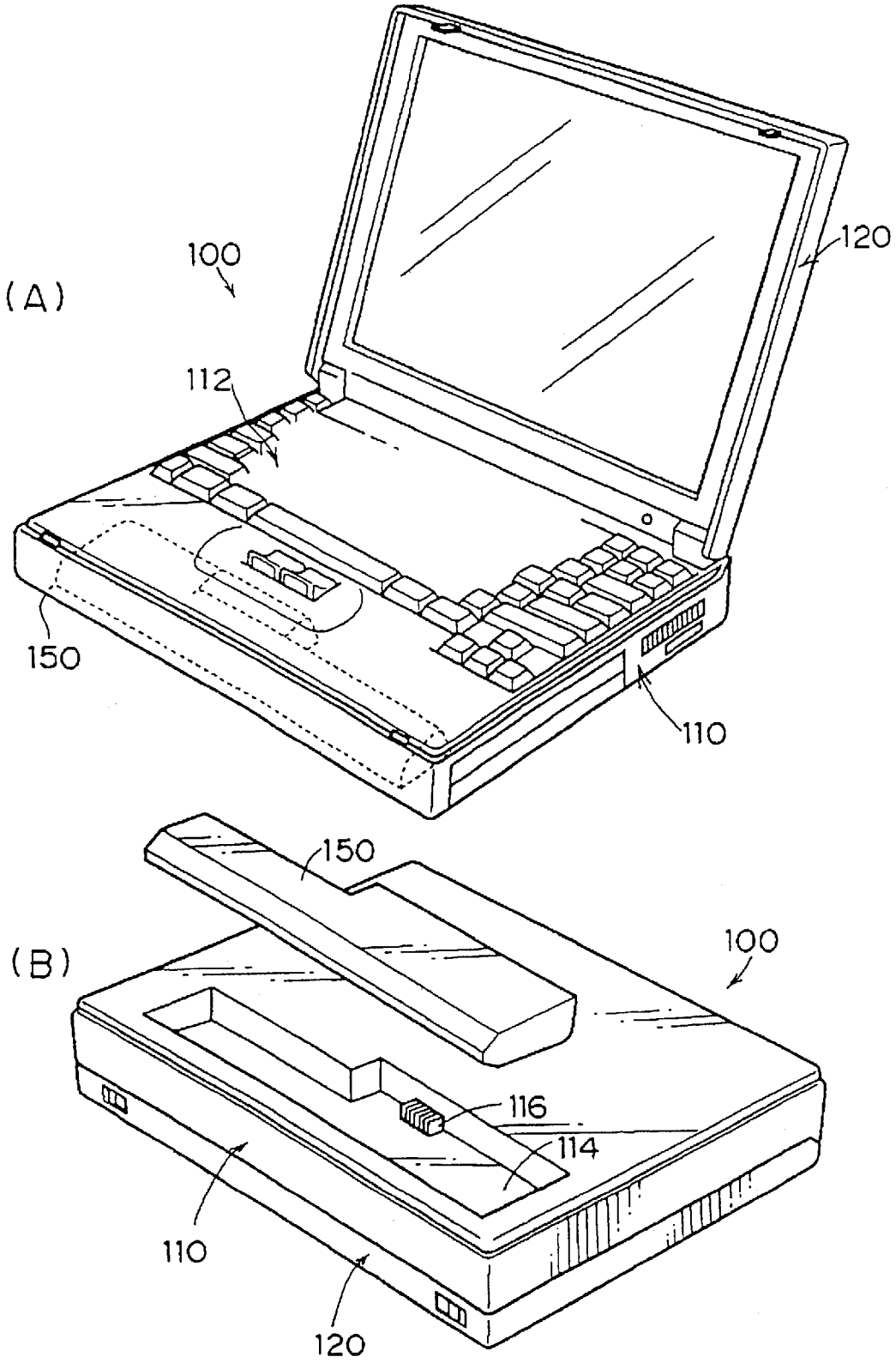

[Figure 2]
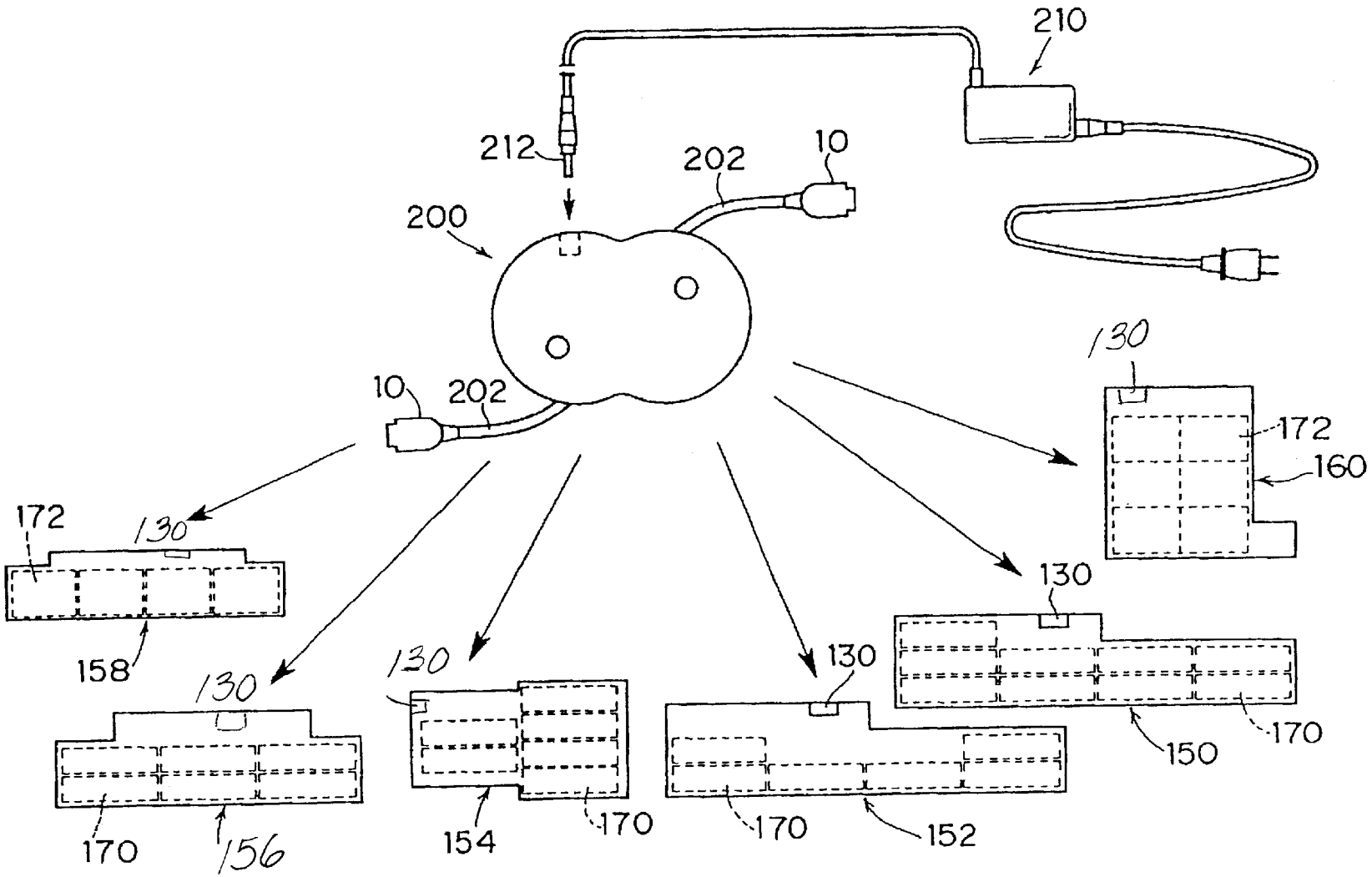

[Figure 3]
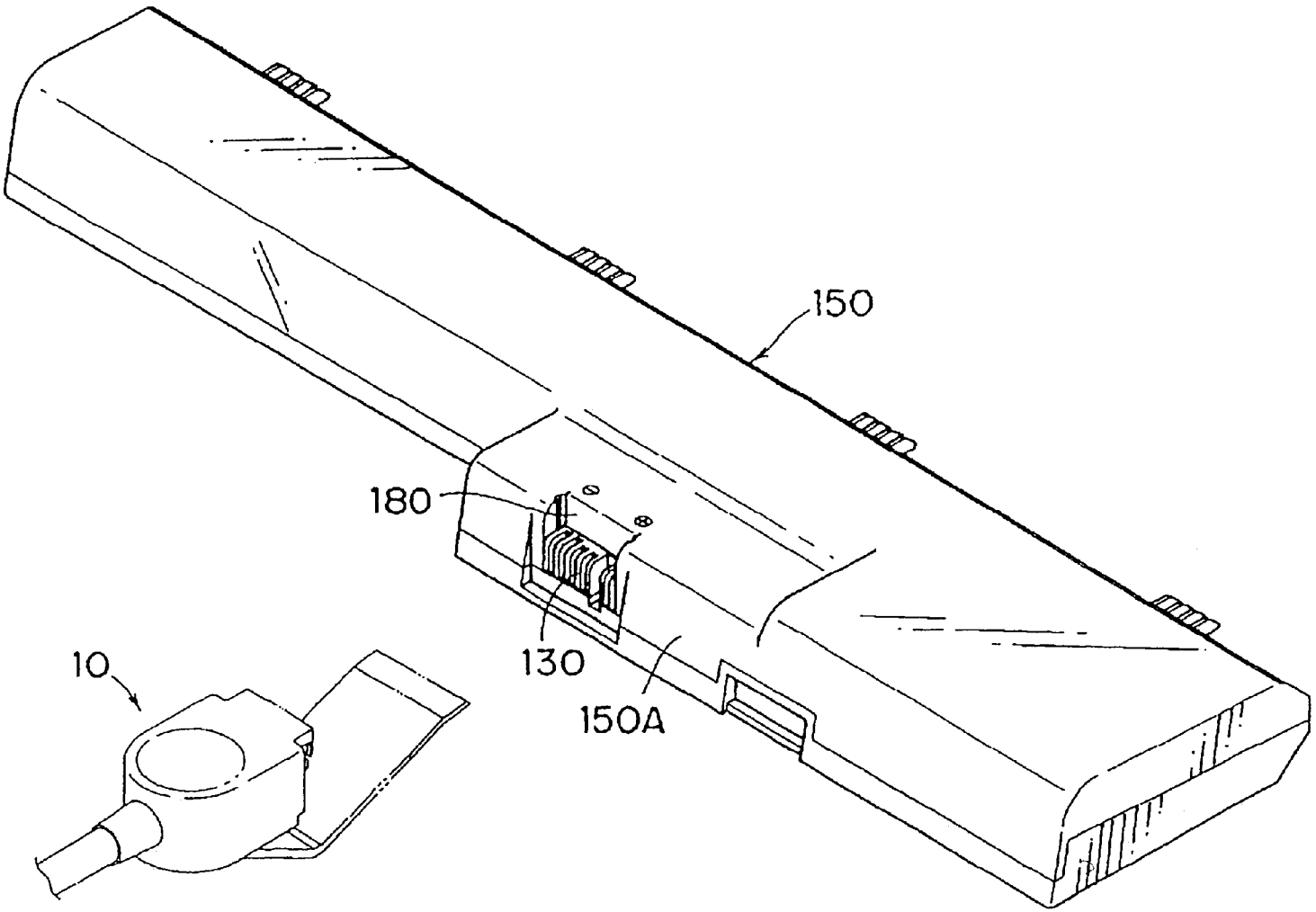

[Figure 4]
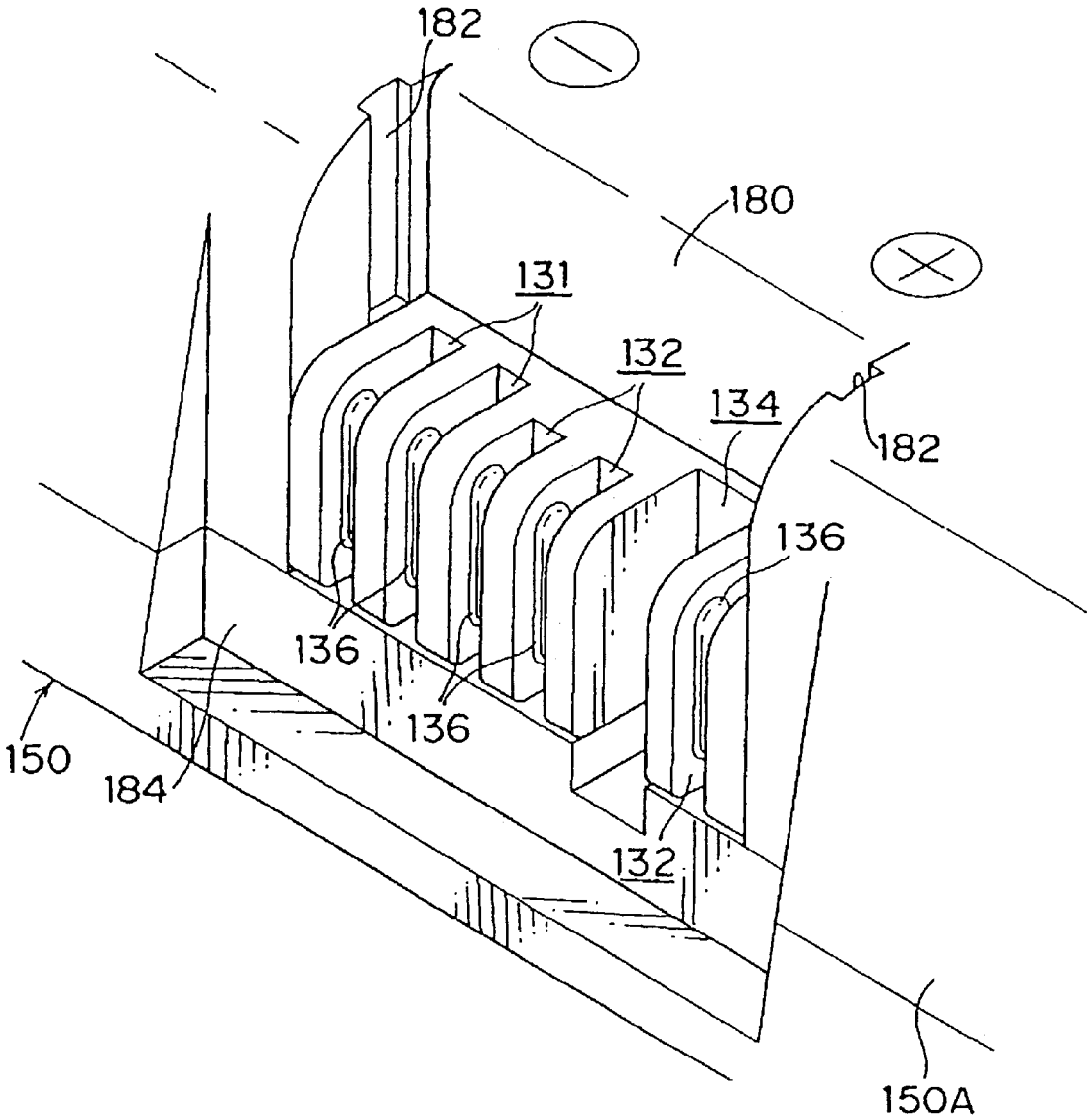

[Figure 5]
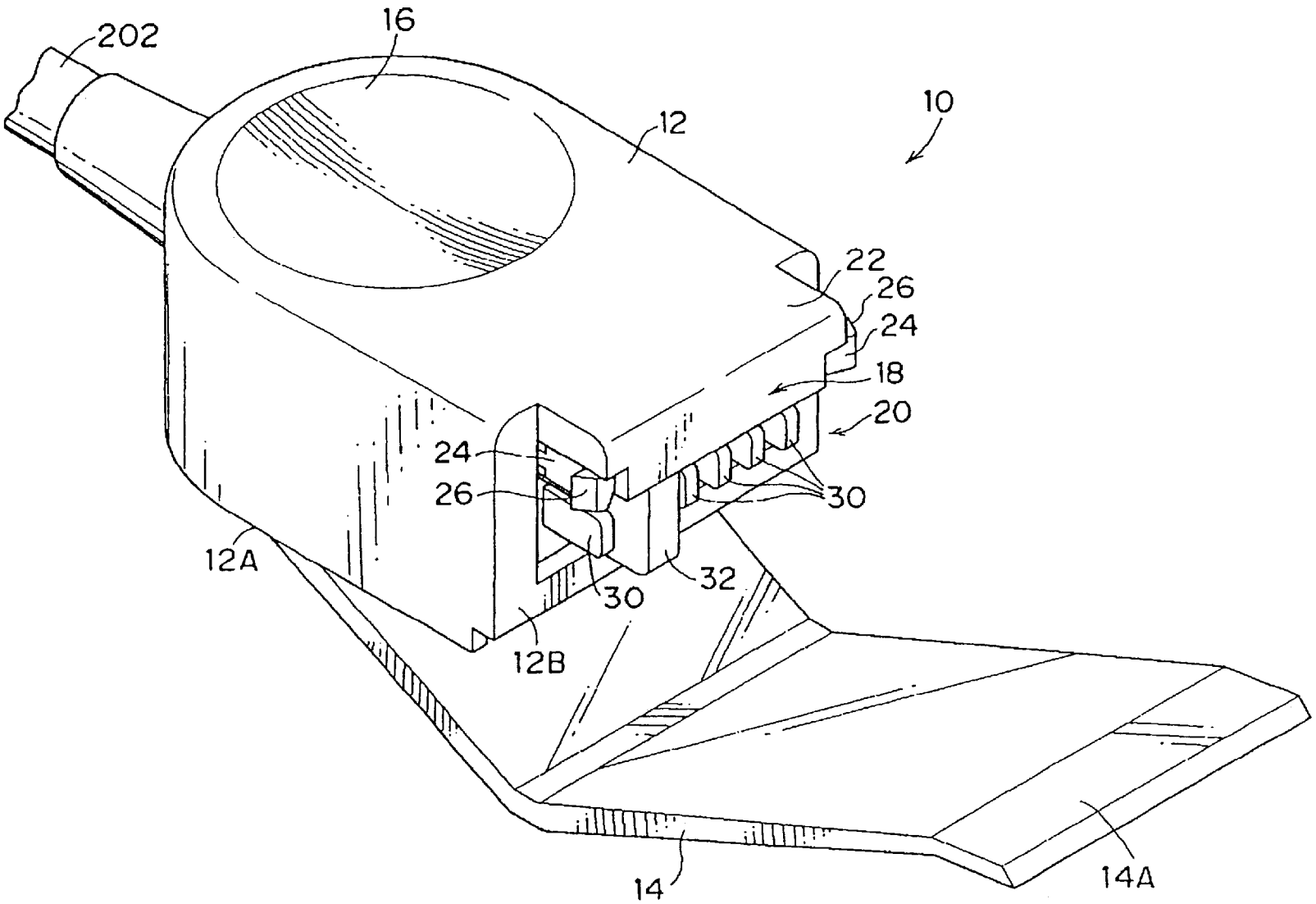

[Figure 6]
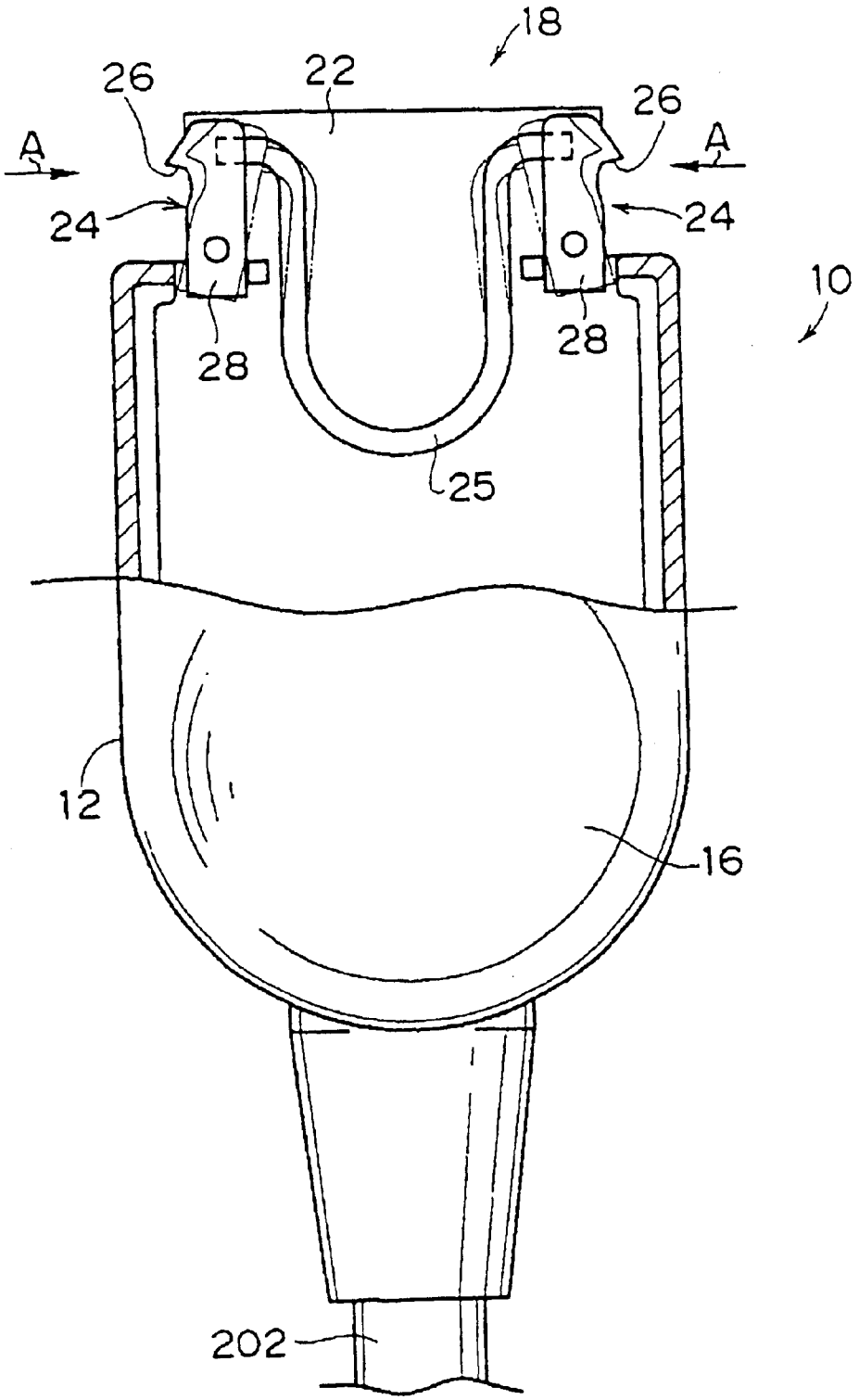

[Figure 7]
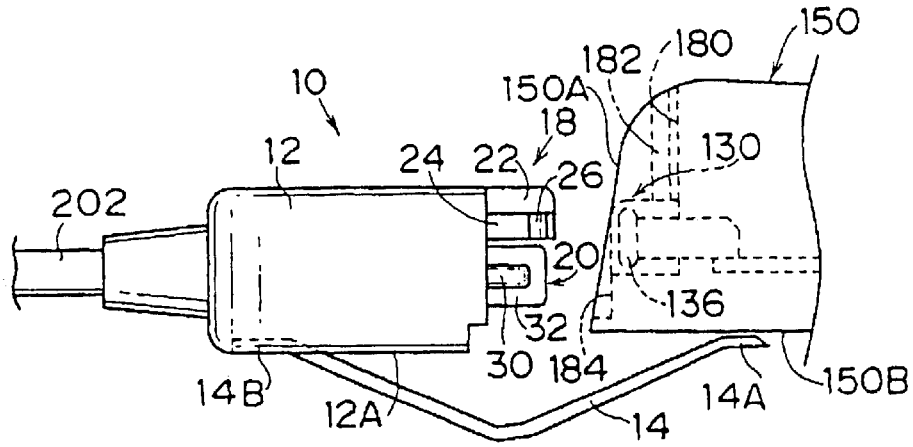
(A)
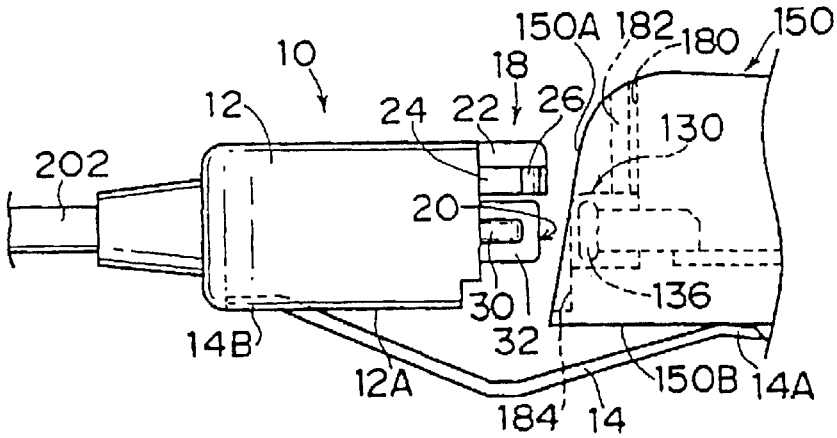
(B)
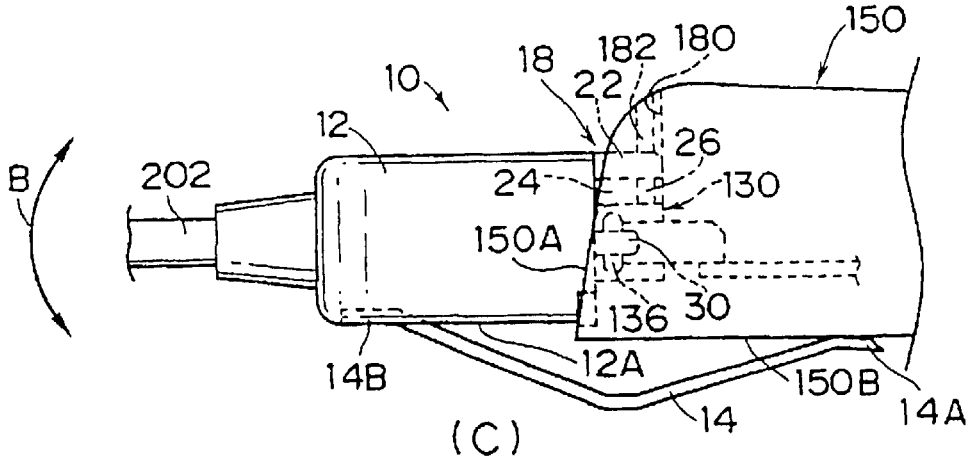
(C)

[Figure 8]
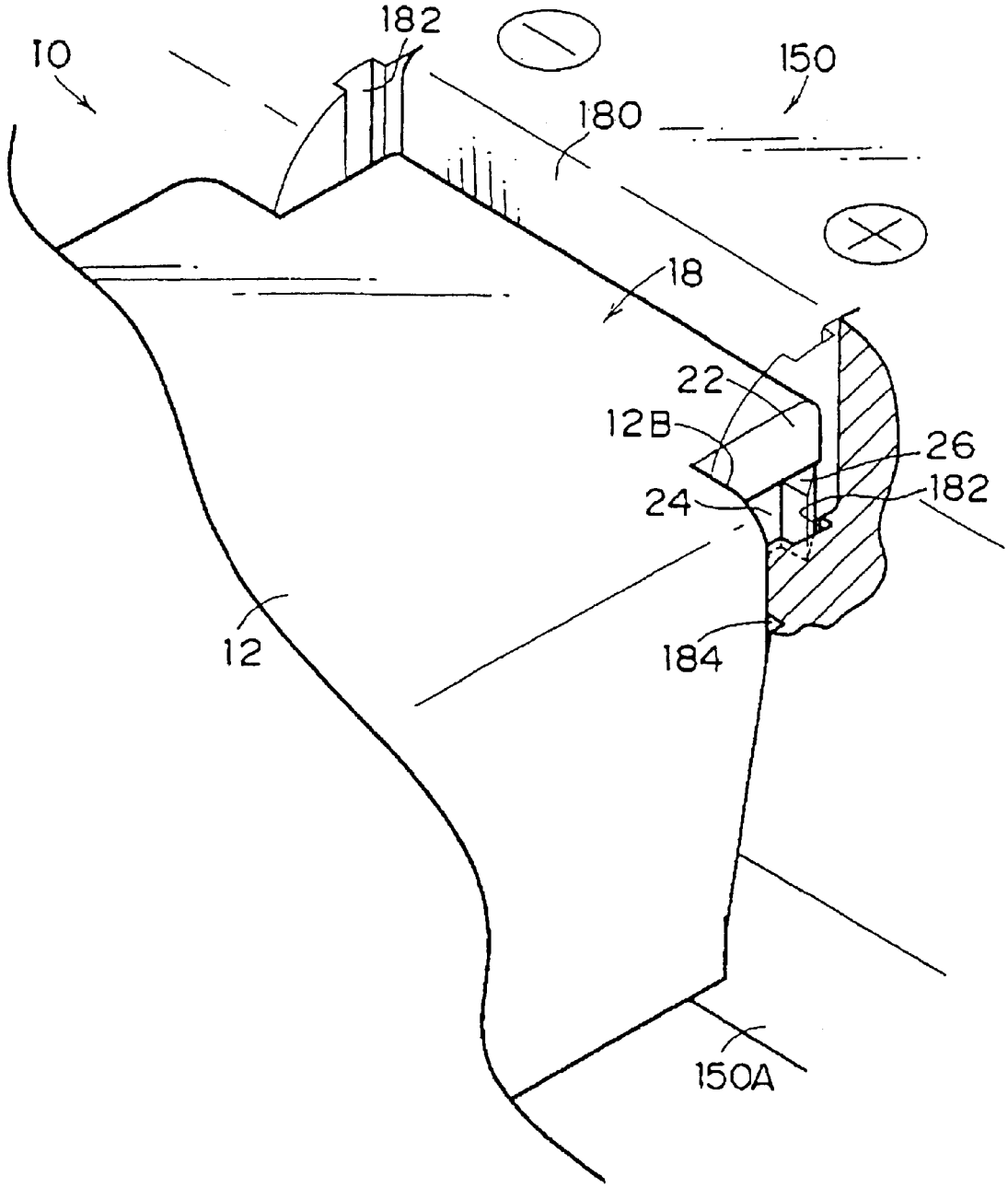

[Figure 9]
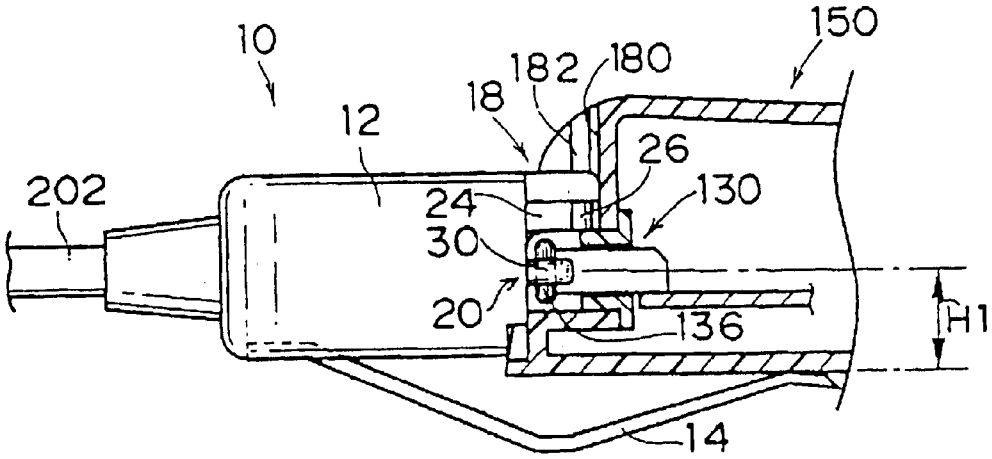
(A)
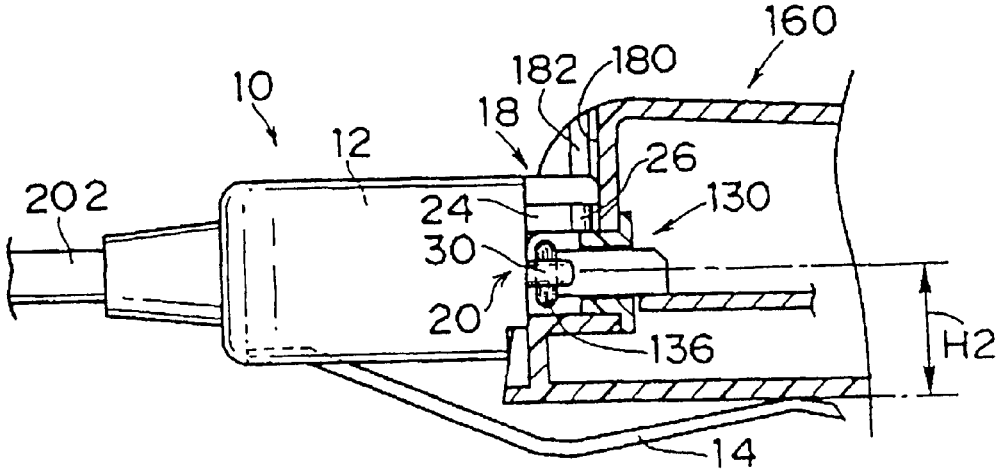
(B)

[Figure 10]
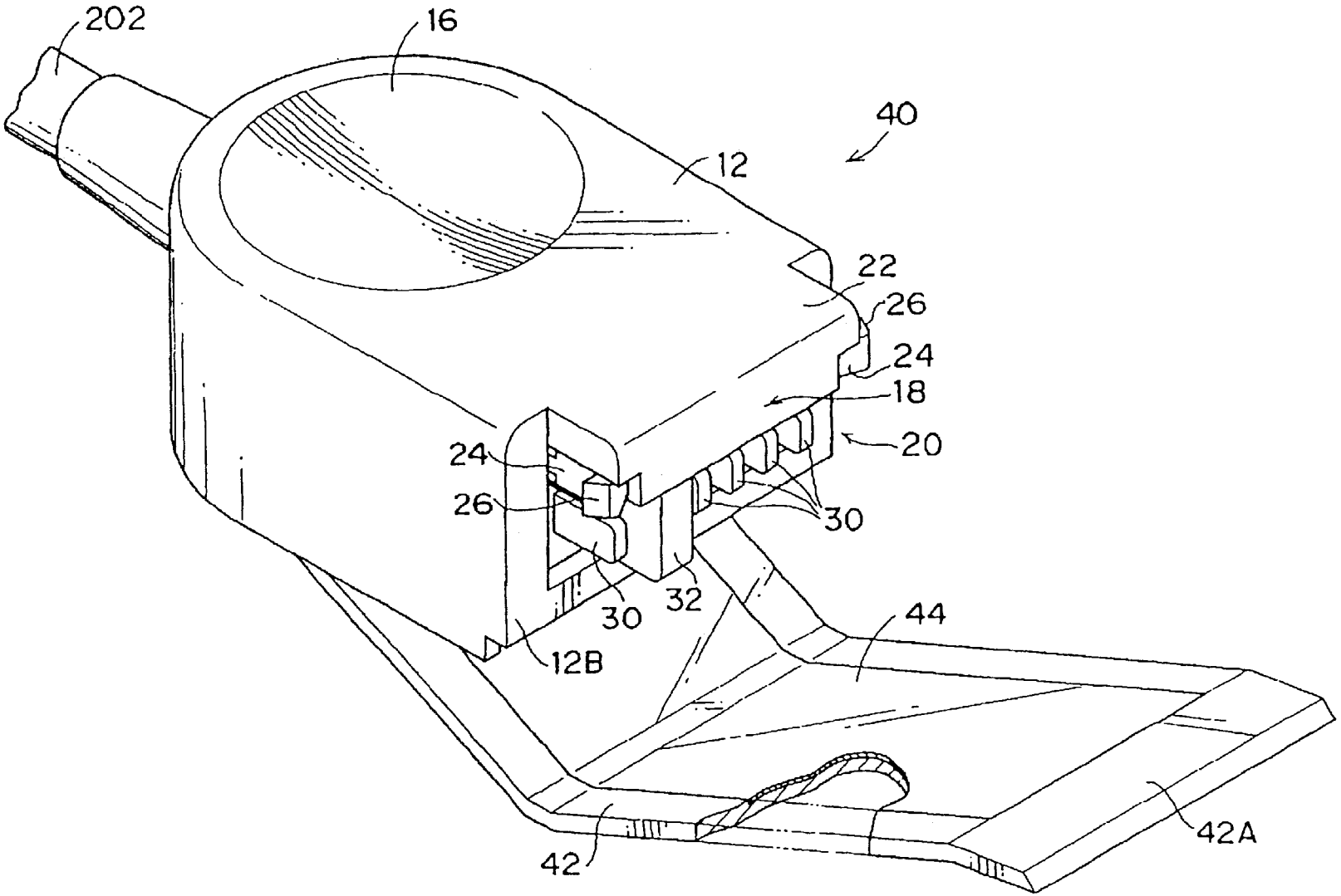

[Figure 11]
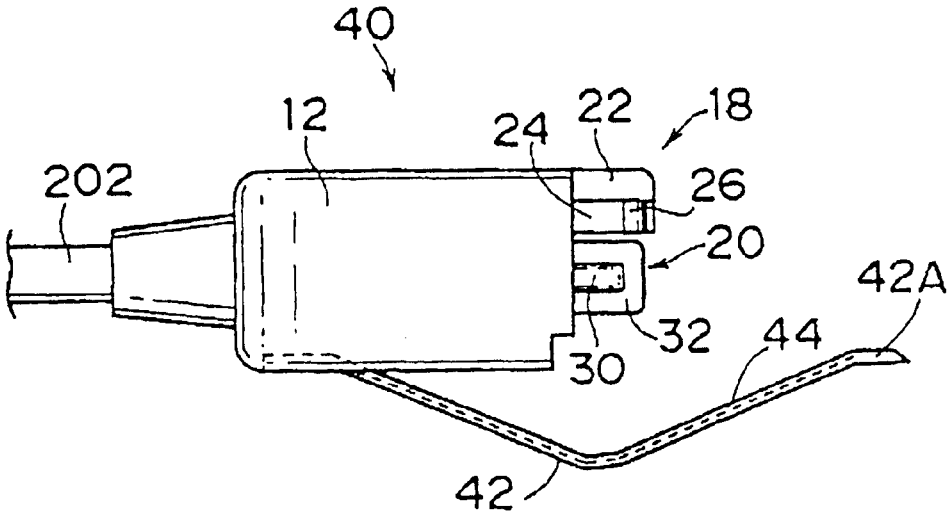

[Figure 12]
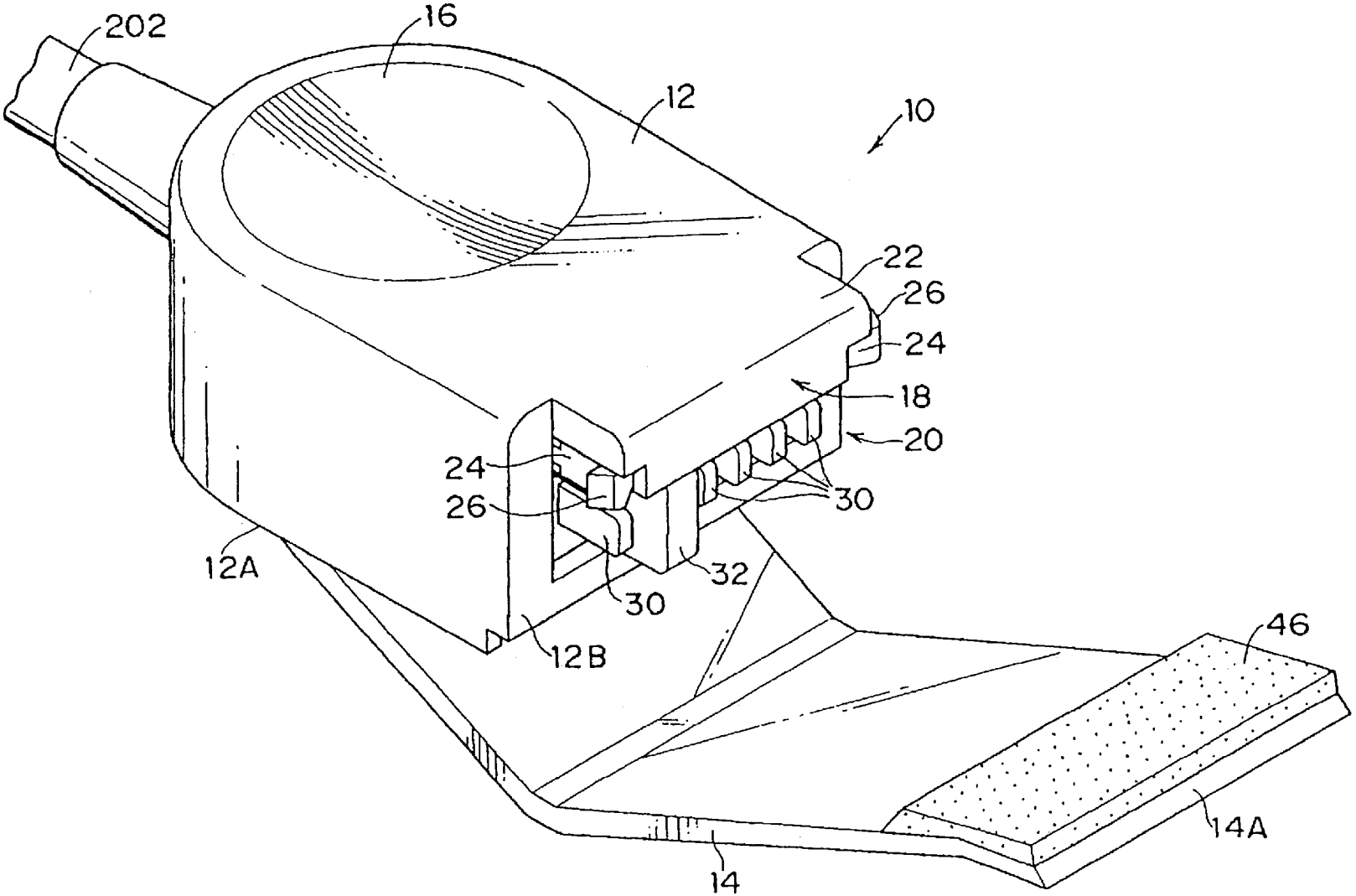

[Figure 13]
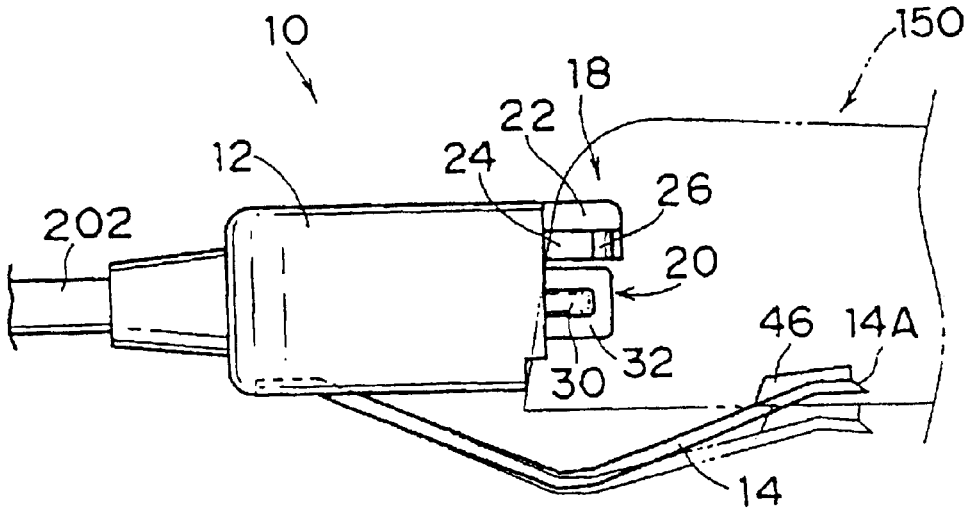

CONNECTOR FOR A BATTERY CHARGER

FIELD OF THE INVENTION

The present invention relates to a connector and a battery charger, and more particularly to a connector to be connected to a battery pack so as to charge the battery pack for a lap-top personal computer, etc., as well as a battery charger equipped with the connector.

BACKGROUND OF THE INVENTION

Portable computers, such as a notebook personal computer (hereinafter, referred to as a lap-top PC), etc., which are typically configured to be compact and lightweight for portability, are often provided with a removable packaged battery (hereinafter, referred to as a battery pack).

Generally, the size and/or the shape of such a battery pack is determined by the dimensional size, inner layout, mounted battery position, etc. of the subject lap-top PC and may therefore be different from each other among PC types. In addition, the battery communication method and the battery connector for electrical connection are also often different from each other among battery pack types. Consequently, each of these conventional battery packs has required a dedicated battery charger.

For example, a lap-top PC line-up may have 5 types of battery packs prepared for 11 PC types and 5 types of battery chargers are supplied to cope with the diversified battery packs.

In recent years, however, model-change cycles of those lap-top PCs are getting shorter and shorter in order to supply higher performance and lower price PCs in a timely manner to markets where the competition is becoming more and more severe. On the other hand, the line-ups of these lap-top PCs are often stepped up in order to meet diversified needs, resulting in an increase in the variety of machine types.

Consequently, it is a heavy burden for the manufacturers to develop a new battery pack and supply a corresponding battery charger for the battery pack each time a new machine type goes on sale, for reducing time taken to develop a new machine type and cutting the price.

On the other hand, for a user who has a plurality of types of such lap-top PCs, it is inconvenient and wasteful to purchase a battery charger for each of those PCs.

In order to overcome the dissatisfaction amongst users, the inventors of the present invention have developed a new battery charger usable commonly for each battery of lap-top PCs in new line-ups by enabling both battery communication method and battery connector to become common among them.

However, the development of such a battery charger has been confronted with a problem associated with the connection between the connector of the charger and the battery connector of the battery pack.

Because the connector of the battery charger in each conventional battery pack can be manufactured independently according to the specific shape and installation place of the battery connector, the connection structure of the connector can be designed very freely, so that it has been easy to design the connector so as to maintain the connection state favorably.

Consequently, for example, the connection between these two connectors can be surely prevented from disconnection even when the battery pack or charger receives a vibration and/or shock during charging.

SUMMARY OF THE INVENTION

For the new battery pack of the present invention, however, a new structure must be designed so as to maintain the connection state favorably, since the mounting position differs slightly from each other among shapes of battery packs although the battery connector has been successfully usable commonly among all the lap-top PCs.

Under such circumstances, it is an object of the present invention to provide a connector that enables the connection state to be maintained favorably for each battery pack whose battery connector is attached differently from others and prevented from unexpected disconnection, as well as a battery charger that employs such the connector.

In order to achieve the above object, the connector of the present invention provides a latching member protruding from the connector body to be engaged with the engaging member located at the connection portion when its connection portion is connected to the battery connector located at the connection portion of the subject battery pack. At the same time, while at least in this connection state, the pinching member of the connector comes in contact with the battery pack, thereby pinching the battery connector between itself and the latching member so as to maintain the connection portion connected electrically to the battery connector.

In particular, the connector maintains the connection state favorably due to an engaging force of the latching member engaged with the connection portion and a pinching force for enabling the battery connector to be pinched between the latching member and the pinching member. Consequently, for example, the connection state can be maintained due to a resisting force generated by those two forces even when a drawing force works at the connection portion in the opposite direction of the connecting direction.

This is also true in a case in which a rotating force works at the connection portion; the pinching force generated by the latching member and the pinching member works as a high resistance to the rotation moment of the connector, therefore the connector is prevented from disconnection from the battery pack.

Furthermore, because the battery connector is pinched between the latching member and the pinching member, it is possible to eliminate a difference of the attaching size between the battery pack and the position of the attached battery connector by extending or shortening space between the latching member and the pinching member even when, for example, the attached position of the battery connector in the thick direction of the battery pack differs slightly from each other among battery pack types. Consequently, the connector of the present invention can be connected favorably to any battery packs that are different from each another in the positions of attached battery connectors.

As described above, according to the present invention, it is possible to assure the favorable connection state of the battery pack whose position for attaching the battery connector is different from others and prevent easily from disconnection from the battery pack even when a drawing force or rotating force works at the connector.

The pinching member may be longer than the protrusion length of the latching member protruding from the connector body.

Further, because the latching member must be engaged with the engaging member of the connection portion, the size and protruded length of the latching member is limited by the shape, etc. of the connection portion of the battery pack. On the other hand, the pinching member is not limited by the shape, etc. of the connection portion of the battery pack, since it is just required to come in contact with the battery pack and work to pinch the battery connector between itself and the latching member.

Consequently, the length of the pinching member is variable. In case the pinching member is set longer than the protruded length of the latching member, when a rotating force is applied to the connector, the pinching member can generate a larger resisting force, thereby preventing the connector from disconnection more effectively.

Furthermore, because it is possible to guide the connection portion of the connector to the battery connector while the pinching member slides on the outer surface of the battery pack, the connector can be connected to the battery pack more easily.

The pinching member may be a cantilivered plate piece made of synthetic resin and may be bent so that its free end is positioned nearer to the latching member than the fixed end while it is in the free state.

The pinching member, in case it is an open-side plate piece made of synthesized resin, can be changed in elasticity, so that the battery connector can be pinched between itself and the latching member. In addition, because it is easy to manufacture the pinching member, its price can be reduced.

Furthermore, in case the plate piece is bent and its free end (tip) is positioned nearer to the latching member side than the fixed end (datum end), the pinching member can be changed more largely when the battery connector is pinched between itself and the latching member, thereby improving the pinching force more.

Furthermore, this plate piece may have a metallic plate spring formed by insert-molding.

In case the plate piece and such a metallic plate spring as a plate spring made of a SUS material or the like are formed together by insert-molding, the strength and durability of the plate piece can be improved more. Consequently, for example, in case the plate piece is put in contact with the bottom of the battery pack, the plate piece is not deformed so easily even when it is pressed by the tare weight of the battery pack. And, the plate piece can keep its rigidity so as to be prevented from deterioration of the pinching force even when it is warmed by a heat generated from the battery pack during charging.

Furthermore, because this plate spring is formed by insert-molding, that is, structured so as to be covered with synthesized resin and not to be exposed to external, the battery pack is prevented from such damages as scratches and dents caused by direct touches of something on the outer surface thereof nor causes user's hands to be injured by touching the battery pack.

Because the plate spring is just required not to be exposed at a place where it comes in contact with the periphery of the plate piece and the battery pack, it may be required just to cover the periphery of the plate piece and the contact portion.

Furthermore, an elastic member made of a polymeric material may be fixed at the free end side of the plate piece.

In a case such an elastic member made of a polymeric material, for example, synthetic rubber or the like, is fixed at the free end side of the plate piece, the elastic member comes in contact with the battery pack while the connector is connected to the battery pack, thereby the elastic member generates a large frictional force and prevents the plate piece from slipping and the battery pack from such damages as scratches and dents more effectively.

The battery charger of the present invention is characterized in that it comprises the above described connector.

BRIEF DESCRIPTION OF THE DRAWINGS

FIG. 1 is an external view of a lap-top personal computer and a mounting position of a battery pack in a personal computer according to an embodiment of the present invention.

FIG. 2 shows a battery charger and types of battery packs that can be charged by the battery charger according to an embodiment of the present invention.

FIG. 3 is a perspective view of the battery pack shown in FIG. 1.

FIG. 4 is an enlarged perspective view of a battery connector mounted in the battery pack shown in FIG. 3.

FIG. 5 is a perspective view of a connector according to an embodiment of the present invention.

FIG. 6 is a partial cross sectional view of a mechanism of a latching member of the connector shown in FIG. 5.

FIG. 7 shows a procedure for connecting the connector shown in FIG. 5 to the battery connector of a battery pack.

FIG. 8 is an enlarged perspective view of the connector shown in FIG. 5, wherein the connector is connected to the battery connector of a battery pack and its latching member is locked.

FIG. 9 shows how the connector shown in FIG. 5 is connected to a battery pack in which the battery connector is located differently from others.

FIG. 10 is a perspective view of a variation of the connector shown in FIG. 5.

FIG. 11 is a side view of the connector shown in FIG. 10.

FIG. 12 is a perspective view of another variation of the connector shown in FIG. 5.

FIG. 13 is a side view of the connector shown in FIG. 12.

DETAILED DESCRIPTION OF THE INVENTION

Now, preferred embodiments of the present invention will be described, by way of example only, with reference to the accompanying drawings.

FIG. 1 shows where a battery pack 150 is installed in a lap-top personal computer 100 (hereinafter, referred to as the lap-top PC 100) in one embodiment of the present invention.

As shown in FIG. 1(A), the PC body 110 of the lap-top PC 100 has a keyboard unit 112 on its top surface, as well as a mother board on which a CPU, a memory, a peripheral controller chip, etc. are mounted and peripheral devices (not shown) including a hard disk drive (HDD), a floppy disk drive (FDD), a CD-ROM drive, etc. inside itself.

On the rear end of the PC body 110 is pivoted rotatably a liquid crystal display (LCD) unit 120.

The battery pack 150, as shown in FIG. 1(B), fits in a battery pit 114 formed so as to be recessed at the front end side of the bottom of the PC body 110. When the battery pack 150 is fitted in the battery pit (as shown in FIG. 1(A)), a battery connector located at one side of the battery pack is connected electrically to a connector 116 of the PC body 110 (inside the battery pit 114).

Consequently, a driving electric power is supplied from the battery pack 150 to the lap-top PC 100, thereby operating PC 100. The driving electric power for an ordinary lap-top PC can be supplied not only from such a battery pack, but also from an AC power source.

FIG. 2 shows the battery charger in this embodiment and a plurality of types of battery packs to be charged by the battery charger. As described above, the same battery connector is employed commonly for each of those battery packs. In this embodiment, a single type battery charger 200 can be used for charging six types of battery packs (150, 152, 154, 156, 158, and 160) equipped with the same type battery connector 130 respectively.

The battery charger 200 is connected to a terminal 212 of an AC adapter 210 so as to supply DC electric power converted from AC electric power by the AC adapter 210 to any of the battery packs 150, 152, 154, 156, 158, and 160 via a connector 10 connected to a tip of a cable 202. Each of the battery packs can supply electric power to its corresponding lap-top PC after it accumulates charged electric power in its built-in battery cells 170 and 172.

In this embodiment, the battery charger 200 is provided with two connectors 10 so as to switch the electric power charged from the AC adapter 210 to be output to each connector. The battery charger 200 can charge two battery packs connected thereto simultaneously.

Each battery pack connector, that is, a battery connector 130 connected to the connector 116 of the lap-top PC 100 or the connector 10 of the battery charger 200, as shown in FIG. 3, is disposed and embedded at the lower side of the recess 180 (connection portion) formed at the side face 150A of the battery pack 150 (For other battery packs, are also embedded the battery connectors at one side of the respective battery pack). Hereinafter, this battery connector 130 will be described.

The battery connector 130 is made of an insulating plastic material. As shown in FIG. 4, the connector 130 has slits 131, 132, and 134 used to fit the plug and the guide of the connector 10 (to be described later) therein. The slits 131, 132, and 134 are recessed in the thick direction of the battery pack 150 so as to form both upper and front open portions (towards the side face 150A).

There are a total of five slits 131 and 132 used to fit the plugs of the connector 10 therein. On the inner wall surface of each of those slits 131 and 132 are disposed a pair of terminals 136 coming in contact with the plugs so as to face each other (only one terminal is shown in FIG. 4). The pair of terminals 136 are exposed and protruded at a predetermined height from the wall surface.

These terminals 136 are made of metal (conductor) and used as plus and minus terminals and as control signal terminals for communications of such information as the residual capacity of the battery, etc. between the lap-top PC 100 and the battery pack 150. Those terminals are disposed in the corresponding slits 131 and 132.

The slit 134 used to fit the guide of the connector 10 therein is larger in both width and depth than those of the slits 131 and 132. The slit 134 has no terminal on its inner wall surface.

In the recess 180 in which the battery connector 130 is disposed such way are also a pair of grooves 182 formed in the thick direction of the battery pack 150 and disposed in the upper portions of the battery connector 130 to lock a latching member of the connector 10 (to be described later).

Furthermore, in front of the battery connector 130 is formed a connector contact portion 184 so as to be recessed by a predetermined depth into the side face 150A of the battery pack 150 and aligned almost to the front face of the battery connector 130. This connector contact portion 184 limits the connector 10 in its insertion direction so as to be connected to the battery connector 130.

FIG. 5 shows the connector 10 and FIGS. 6 and 7 show the connector 10 attached to the battery charger 200. The connector 10 has both the connector body 12 and a keep plate 14 fixed to the bottom face 12A of the connector body 12.

The connector body 12 has a circular recess 16 on its top face. The recess 16 is formed so as to make it easy to pick the connector 10 up. And, at a tip of the connector body 12 is formed a latching member 18 and a connector 20 to be connected to the battery pack 150. The latching member 18 is protruded towards the front of the connector body 12 from the upper side and the connector 20 is disposed under this latching member 18.

The latching member 18, as shown in FIG. 6, has a pair of hooks 24 inside a protruded plate 22 and a spring 25 for pressing the hooks 24.

The hooks 24 are disposed almost in parallel with a predetermined spacing therebetween. Each of the hooks 24 has a click 26 formed at the tip and protruded towards the side of the connector 10 from the butt plate 22 and its rear end portion 28 is pivoted rotatably on the butt plate 22. Each of the hooks 24 enables a tip of the spring 25 to be passed and mounted on the opposite surface of the click 26. The spring 25 is made of a metallic line material, which is bent almost like a U-letter in shape. And, when the spring 25 is in the free state, the tips of the clicks 26 of the hooks 24 are kept with a predetermined distance therebetween.

Consequently, the hooks 24, when pressed towards the arrow A shown in FIG. 6, displace the clicks 26 toward the inside of the butt plate 22 due to the elastic deformation of the spring 25 (as shown with a two-dot chain line in FIG. 6). The hooks 24, when released, return to their original positions due to the force of the spring 25. Because the latching member 18 is configured in such a way, it can have such a latching function.

The connector 20 is configured so as to correspond to the battery connector 130 of the above-described battery pack 150. The connector 20 has a total of 5 metallic plugs 30 to be fit in the slits 131 and 132 and connected electrically to the terminals 136, as well as a plastic guide 32 to be fit in the slit 134.

Those plugs 30 and the guide 32 are formed like a flat plate so as to be fit in their corresponding slits. In this embodiment, the guide 32 has a size larger than the plugs 30 so as to be fit in its corresponding slit before the plugs 30 are fit in their corresponding slits. And, the plugs 30 and the guide 32 are disposed more inside than the outer edge of the butt plate 22 of the latching member 18 so as not to be touched by anything external.

Just like the terminals 136, plus and minus of the supply electric power, as well as functions for communicating control signals are distributed among those plugs 30.

On the other hand, the keep plate 14 disposed on the bottom face of the connector body 12 is made of elastic plastic or such synthetic resin as elastomer, etc. It is bent in a V-shape as shown in FIG. 5. And, as shown in FIG. 7(A), the keep plate 14 is fixed and cantilevered about at the rear end of the bottom face 12A of the connector body 12. The tip of the keep plate 14 is protruded towards the front of the connector body 12.

The keep plate 14 is slightly narrower in width than the connector body 12 and about double the connector body 12 in length. In the free state (no loaded), the free end (the tip portion 14A) of the keep plate 14 is positioned slightly higher than the fixed end (the datum end 14B) so as to come close to the latching member 18.

Next, the operation of this embodiment will be discussed.

Usually, the connector 10 is connected to the battery connector 130 of the battery pack 150 in an orientation as shown in FIG. 3.

At first, the connector 10 is brought near to the battery pack 130 from the front side so as to turn the keep plate 14 to the bottom face 150B of the battery pack 150 and make it stay there as shown in FIG. 7(A).

Then, the connector 10 is raised slightly so as to make the tip 14A of the keep plate 14 come in contact with or slide on the bottom face 150B of the battery pack 150. After this, the position of the connector portion 20 is aligned to the battery connector 130.

The connector 10 is brought near to the battery connector 130 as is and the butt plate 22 of the latching member 18 is fit in the recess 180, thereby the plugs 30 and the guide 32 of the connector portion 20 are fit in the slits 131, 132, and 134.

At this time, because the guide 32 is fit in the slit 134 first to fit the plugs 30 in the slits 131 and 132, they are all fit in their corresponding slits smoothly and the plugs 30 are prevented from damages that might occur when they 30 are pressed against the front face of the battery connector 130.

While those plugs and guide are fit in their slits, the hooks 24 are set when the clicks 26 come in contact with the inner surface of the recess 180, pressed against and rotated toward the inside of the butt plate 22 (in the direction of the arrow A in FIG. 6).

In case the connector 10 is further pushed in until the clicks 26 reach the grooves 182, the hooks 24 are rotated outward due to the pressure of the spring 25, thereby the clicks 26 are fit in the grooves 182, as shown in FIG. 8. Almost at the same position, the front face 12B of the connector body 12 comes in contact with the connector contact portion 184, so that the connector 10 is prevented from being further inserted (insertion stop position). The plugs 30 thus come in contact with the terminals 136 of the slits 131 and 132 so as to be connected electrically to those terminals 136.

At this insertion stop position, the battery connector 130 is pinched between the latching member 18 and the keep plate 14 due to the pressure of the keep plate 14 as shown in FIG. 7(C).

The connector 10 connected to the battery connector 130 of the battery pack 150 is thus locked and the battery charger 200 gets ready to charge the battery.

While the connector 10 is inserted almost from the front side of the battery connector 130 in the above connector connection procedure, the procedure is actually flexible in the insertion orientation. Concretely, even when the connector 10 is inclined slightly and inserted from an upper or lower portion obliquely, the latching member 18 is fit in the recess 180 while the positions of both connector portion 20 and battery connector 130 are aligned. The connector 10 can thus be connected to the battery connector 130 smoothly and quickly even when the connector 10 is inserted there a little roughly.

As described above, according to the connector 10 in this embodiment, the connector portion 20 is connected to the battery connector 130 located in the recess 180 of the battery pack 150 first. Then, the hooks 24 of the latching member 18 protruded from the connector body 12 is fit in the grooves 182 of the recess 180. In this connection state, the keep plate 14 comes in contact with the bottom face 150B of the battery pack 150, thereby the battery connector 130 is pinched between the presser plate 14 and the latching member 18. The connector 10 is then locked in this connection state.

The connector 10 is connected more firmly due to the engaging force of this latching member 18 and the pinching force for pinching the battery connector 130 between the latching member 18 and the keep plate 14. Consequently, the connector 10 is not disconnected so easily while the battery is charged even when the cable 202 of the battery charger 200 and/or the battery pack 150 is pulled.

Furthermore, even when a rotating force is applied to the connector 10 in the direction of the arrow B shown in FIG. 7(C), the connector 10 is prevented from disconnection due to its own rotation moment resistance generated by the pinching force between the latching member 18 and the keep plate 14.

Furthermore, because the connector 10 is structured so that the battery connector 130 is pinched between the latching member 18 and the keep plate 14, the connector 10 can cope with slight changes of the fitting position of the battery connector in the thickness direction of the battery pack. Those changes appear among types of battery packs (H1<H2) as shown in FIGS. 9(A) and (B). This is because the deflection deformation of the keep plate 14 can eliminate such a difference between the fitting positions of battery connectors. And, this is why the connector 10 is connected to the subject battery connector 130 favorably in any battery packs in which battery connectors 130 are fit in different positions.

Furthermore, the keep plate 14 in this embodiment is set longer than the latching member protruding from the connector body 12. While the latching member 18 is adjusted to the size of the recess 180 of the battery pack 150 so as to be fit therein as described above, the keep plate 14 is positioned on the bottom surface 150B of the battery pack while the connector is connected. The keep plate 14 can therefore be variable in length.

In case the keep plate 14 is set longer than the latching member just like in this embodiment, therefore, the connector 10 can generate a larger resistance against the rotating force, thereby the connector 10 can be prevented from disconnection more effectively.

Furthermore, because the connector portion 20 can be guided to the battery connector 130 while the keep plate 14 slides on the bottom surface 150B of the battery pack 150, the connector 10 can be connected easily.

Furthermore, because the member for pinching the battery connector 130 is an open-sided bent keep plate 14 made of synthetic resin in this embodiment, it is easy to pinch the battery connector 130 between the keep plate 14 and the connector portion 20 with good use of the elastic deformation of the keep plate 14. And, because the keep plate 14 is made of synthesized resin, the keep plate 14 can be molded, thereby reducing the manufacturing cost.

Furthermore, the keep plate 14 is bent so that its free end in the free state is positioned closer to the latching member 18 than the fixed end. Consequently, the deformation of the keep plate 14 becomes larger when the battery connector 130 is pinched, thereby the pinching force is more improved.

The keep plate 14 in this embodiment is 2 mm in thickness. Consequently, it is possible to obtain a force of 4.9 to 9.8N (about 0.5 to 1 kgf) for inserting/drawing the connector 10 even when the attached position of the battery connector 130 is varied by 4 mm in maximum. In the case of the lap-top PC line-up this time, therefore, because battery packs are 300 to 450 g in weight, the inserting/drawing force value will arise no problem in the practical use of the keep plate 14.

FIGS. 10 and 11 show a variation of this keep plate 14. For the connector 40 in this variation, a plate spring 44 made of a SUS material and the keep plate 42 are put together by the insert-molding method. In this case, however, the keep plate 42 is formed so as to expose the center portion of its top surface while its periphery including the tip portion 42A, as well as its bottom surface are covered.

Because the plate spring 44 is formed by the insert-molding method as described above, the strength and durability of the keep plate 42 are improved more. Even when the plate spring 44 is pressed by the tare weight of the battery pack 150, therefore, the plate spring 44 is not deformed so easily. And, the rigidity of the plate spring 44 is maintained favorably, thereby it is prevented from deterioration of the pinching force even when it is warmed by the heat generated from the battery pack 150 during battery charging.

While the connector 10 is connected, the plate spring 44 is not in contact directly with the bottom face 150B of the battery pack 150. The battery pack is therefore prevented from such damages as scratches and dents and the user is protected from injuries that might occur when the user touches the outer periphery of the plate spring 44.

FIGS. 12 and 13 show another variation of the keep plate 14. In this variation, an elastic piece 46 made of synthesized rubber is fixed to the tip portion 14A of the keep plate 14.

Consequently, as shown in FIG. 13, the elastic piece 46 comes in close contact with the bottom face 150 of the battery pack 150, thereby generating a large frictional force while the connector 10 is connected to the battery pack 150 (as shown with a two-dot chain line in FIG. 13). Consequently, the keep plate 14 can be prevented effectively from slipping, thereby the battery pack 150 is prevented from damages effectively.

This elastic piece 46 may be located at the tip portion of the keep plate 42 of the connector 40 shown in FIG. 10.

The connector of the present invention can apply not only to battery packs mounted in lap-top PCs, but also to battery packs mounted in other electronic devices.

Because the connector and the battery charger of the present invention are configured as described above, it is effective to cope with slight location changes of battery connectors, thereby the connector can be kept connected to the corresponding battery pack satisfactorily and prevented from disconnection.

What is claimed is:

1. A connector, for electrically connecting a battery charger with a battery connector of a battery pack having an engaging member, comprising:

a connector body having a proximal end, a distal end, an upper face and a lower face;

a latching member protruding a predetermined length from the proximal end of the connector body, for engagement with the engaging member of the battery pack;

a cantilever keep place, for tensionably connecting the battery connector and the latching member, disposed on the lower face of the connector body, having a first end connected to the distal end of the connector body and a second end extending a predetermined distance beyond the proximal end of the connector body, wherein the second end is situated along a horizontal plane above and parallel with a longitudinal axis of the lower face, and the predetermined distance the second end extends beyond the proximal end of the conductor body is greater than the predetermined length the latching member protrudes from the proximal end of the connector body; and a connection portion disposed at the proximal end of the connector body, which protrudes beyond the proximal end of the connector body for electrical connection of the connector with the battery connector.

2. The connector according to claim 1, wherein said cantilever keep plate is comprised of a synthetic resin and is shaped such that when the plate is in a first state, the second end of the plate is proximately configured with respect to the latching member more so than the first end.

3. The connector according to claim 2, wherein an elastic member made of a polymeric material is fixedly secured to the second end of the plate.

4. A battery charger including a connector, for electrically connecting with a battery connector of a battery pack having an engaging member, comprising:

a connector body having a proximal end, a distal end, an upper face and a lower face;

a latching member protruding a predetermined length from the proximal end of the connector body, for engagement with the engaging member of the battery pack;

a cantilever keep plate, for tensionably connecting the battery connector and the latching member, disposed on the lower face of the connector body, having a first end connected to the distal end of the connector body and a second end extending a distance beyond the proximal end of the connector body greater than the predetermined length of the latching member wherein the second end is situated along a horizontal plane above and parallel with a longitudinal axis of the lower face; and a connection portion disposed at the proximal end of the connector body, which protrudes beyond the proximal end of the connector body for electrical connection of the connector with the battery connector.

5. The connector according to claim 4, wherein an elastic polymeric member is fixedly secured to the second end of the plate.

* * * * *